US006779579B2

(12) United States Patent
Bardini et al.

(10) Patent No.: US 6,779,579 B2
(45) Date of Patent: Aug. 24, 2004

(54) REINFORCEMENT DEVICE

(75) Inventors: Sergio Antonio Bardini, Limeira (BR); Edson Dos Santos, Limeira (BR); Ednilson Jose Ulrich, Limeira (BR)

(73) Assignee: Meritor Do Brasil LTDA. Divisao LVS (BR)

( * ) Notice: Subject to any disclaimer, the term of this patent is extended or adjusted under 35 U.S.C. 154(b) by 0 days.

(21) Appl. No.: 10/258,508

(22) PCT Filed: Apr. 27, 2001

(86) PCT No.: PCT/BR01/00054

§ 371 (c)(1),
(2), (4) Date: Aug. 21, 2003

(87) PCT Pub. No.: WO01/83131

PCT Pub. Date: Nov. 8, 2001

(65) Prior Publication Data

US 2004/0045333 A1 Mar. 11, 2004

(30) Foreign Application Priority Data

Apr. 28, 2000 (BR) ..... 0002153

(51) Int. Cl.[7] ..... B32B 31/00
(52) U.S. Cl. ..... 156/555; 156/582
(58) Field of Search ..... 156/555, 580, 156/582, 583.1; 100/327, 155 R, 160, 176

(56) References Cited

U.S. PATENT DOCUMENTS 4,067,217 A 1/1978 Bisaillon et al.
4,316,374 A * 2/1982 Nagatsuma ..... 72/91
4,825,675 A 5/1989 Shinozawa et al.
5,515,709 A * 5/1996 Lowe et al. ..... 72/105
5,531,024 A * 7/1996 Lowe et al. ..... 29/894.323
6,145,563 A * 11/2000 Kalisiak et al. ..... 156/555

FOREIGN PATENT DOCUMENTS

DE 44 05 353 C1 1/1995

* cited by examiner

*Primary Examiner*—James Sells
(74) *Attorney, Agent, or Firm*—Alston & Bird LLP

(57) ABSTRACT

The present invention relates to a reinforcement device (1, 100), especially a reinforcement device useable in a machine for laminating rims for wheels of automotive vehicles, the machine comprising at least two substantially parallel laminating axles (21, 22, 121, 122), the reinforcement device (1, 100) being characterized by comprising a body (4, 101) associated to the housing (2, 102) of the lamination machine, the positioning of the body being variable with respect to the housing (2, 102), the body (4, 104) being provided with two bearings (41, 42, 141, 142) supportable on respective end regions of the axles (21, 22, 121, 122), so that the axles (21, 22, 121, 122) are maintained substantially parallel during the operation of laminating the rim, at least one bearing being moveable with respect to the reinforcement device by a moving means (51, 52, 150). With great advantages, the invention can be used in usual lamination machines existing in the factory, thus making it possible to manufacture larger and more resistant wheel rims, with good quality and reduced cost, without potentially destructive overloads on the machine. In addition, the device brings about greater uniformity between the successive lots of rims produced, besides reducing the dimensional tolerances of each piece, which results better quality and more satisfaction of the clients.

17 Claims, 6 Drawing Sheets

REINFORCEMENT DEVICE

The present invention relates to a reinforcement device, especially for use in machines for laminating wheel rims of automotive vehicles.

DESCRIPTION OF THE PRIOR ART

Usually, machines for laminating wheel rims of the simple-support type do not have any kind of reinforcement mechanism to aid in performing their function. While performing the lamination operations, the two axles of the machine that approach each other to form the piece mechanically undergo a flexion due to their length and to the force applied to carry out the lamination. When laminating wheel rims that have measures of up to 40.6 cm (16") in diameter and that are constituted by low-resistance materials, the flexion effort to which the axles of the machine are subjected are within the parameters foreseen in project, and they have coherent useful life.

However, with the need for manufacturing wheel rims of up to 50.8 cm (20") in diameter and made of considerably more resistant materials, it became necessary to apply considerably greater conformation efforts, which caused a load on the axles of the machines heavier than that determined by the manufacturer as the maximum admissible load. As a result, the useful life of the axles and their adjacent components, such as rollers and hydraulic pressure lines was substantially shortened. What is worse, it was not possible to foresee when a break would occur, which constantly leads to non-programmed stoppages of the machine for repair and consequent delays in the production line and damages.

OBJECTIVES OF THE INVENTION

The present invention is a reinforcement device that can be used in usual laminating machines existing in factories, making possible the manufacture of larger and more resistant wheel rims, with good quality and low cost, without potentially destructive overloads on the machine. Since the device of the present invention prevents flexion of the laminating axles, the rim can be mechanically conformed with lesser deformation load, which avoids overload on the hydraulic system of the machine, which generates this force, and also spares the axles and other adjacent components such as rollers, which are subjected to loads for which they were designed, without excess. In addition, breaks are prevented, which constantly lead to non-programmed stoppages of the machine for repair and consequent delay in the production line and damages. Also, the device brings about greater uniformity between the successive lots of rims produced, besides reducing dimensional tolerances of each piece, which results in better quality and more satisfaction of the clients.

BRIEF DESCRIPTION OF THE INVENTION

The present invention describes a reinforcement device, especially a reinforcement device that can be used in a machine for laminating wheel rims for automotive vehicles, the machine comprising at least two substantially parallel rim-lamination axles, the reinforcement device comprising a body associated to the housing of the lamination machine, the positioning of the body varying with respect to the housing, the body being provided with two bearings supportable on respective end regions of the axles, so that the axles are substantially maintained parallel during the operation of laminating the rim, at least one bearing being moveable with respect to the reinforcement device by a moving means.

In a first preferred embodiment of the invention, the body is substantially C-shaped, having two bearings moveable axially with respect to the body and in a synchronized way, in opposite directions, by respective first and second moving means.

In a second preferred embodiment of the invention, the body comprises two substantially parallel bars, which are joined, at respective first ends, to a reinforcement element and at their second ends, to a first bearing, the body being moveable by a fifth moving means in the direction of the length of the body. The second bearing is fixed with respect to the reinforcement device.

BRIEF DESCRIPTION OF THE DRAWINGS

The present invention will now be described in greater details with reference to an embodiment represented in the drawings. The figures show.

DETAILED DESCRIPTION OF THE FIGURES

Figure 1:
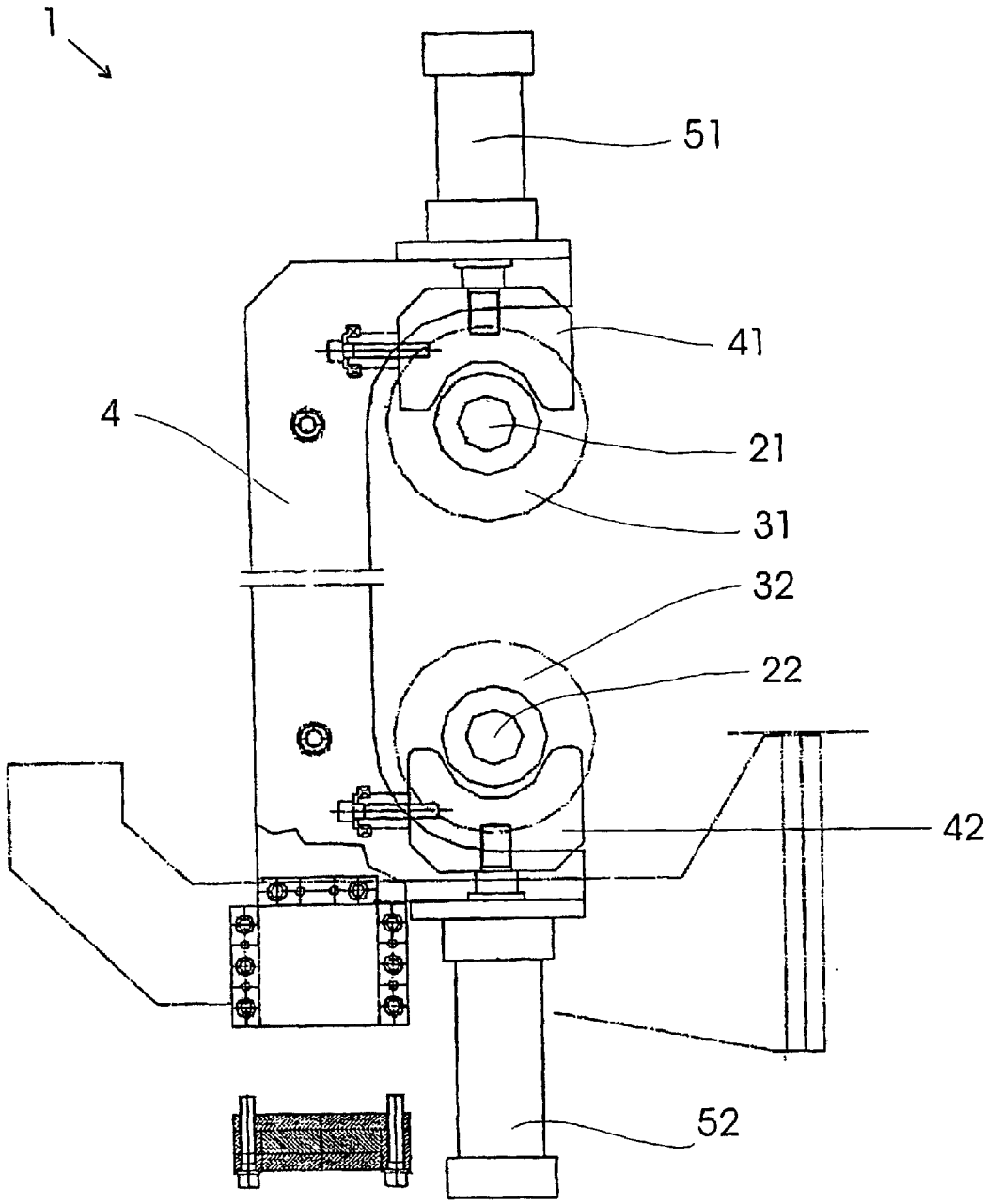
FIG. 1: a front view of a first configurative variation of the reinforcement device of the present invention.
Figure 2:
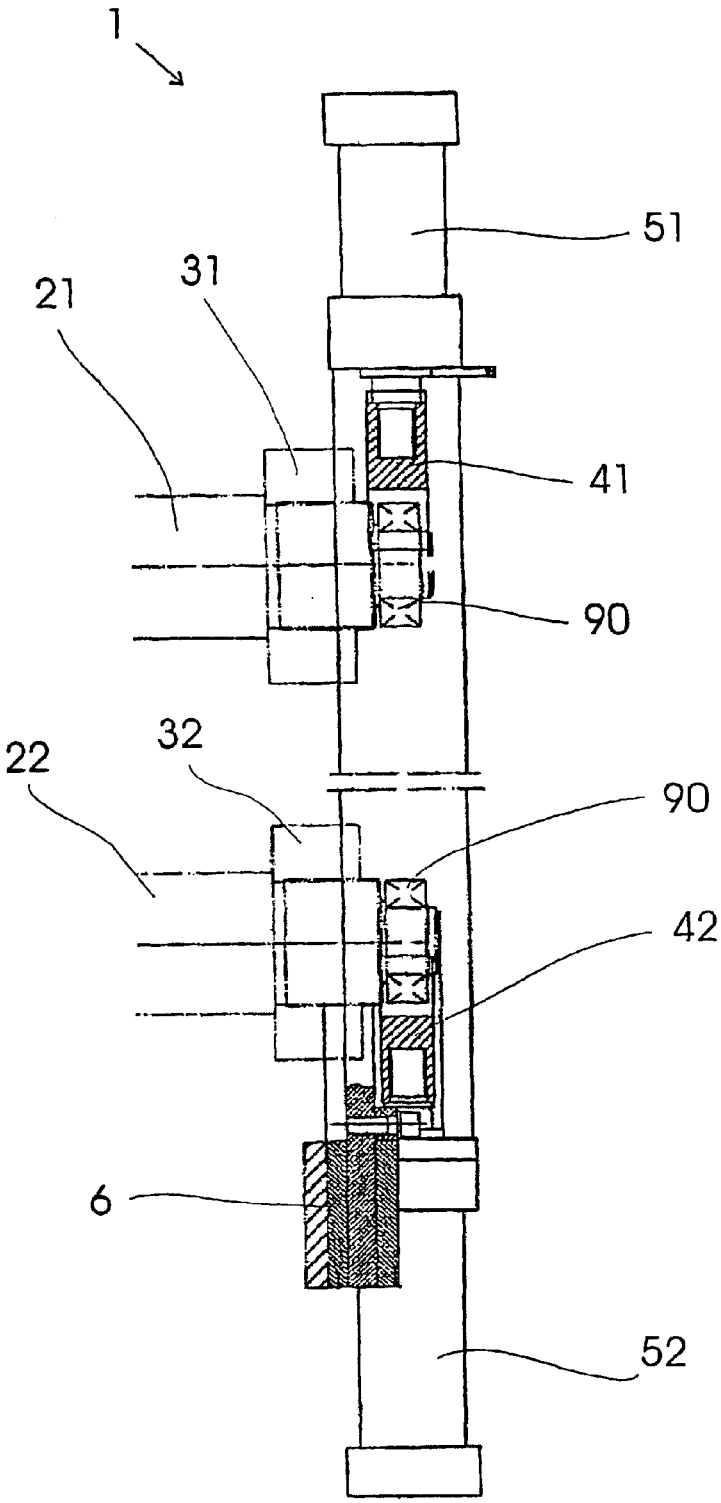
FIG. 2: a side view of the device illustrated in FIG. 1.
Figure 3:
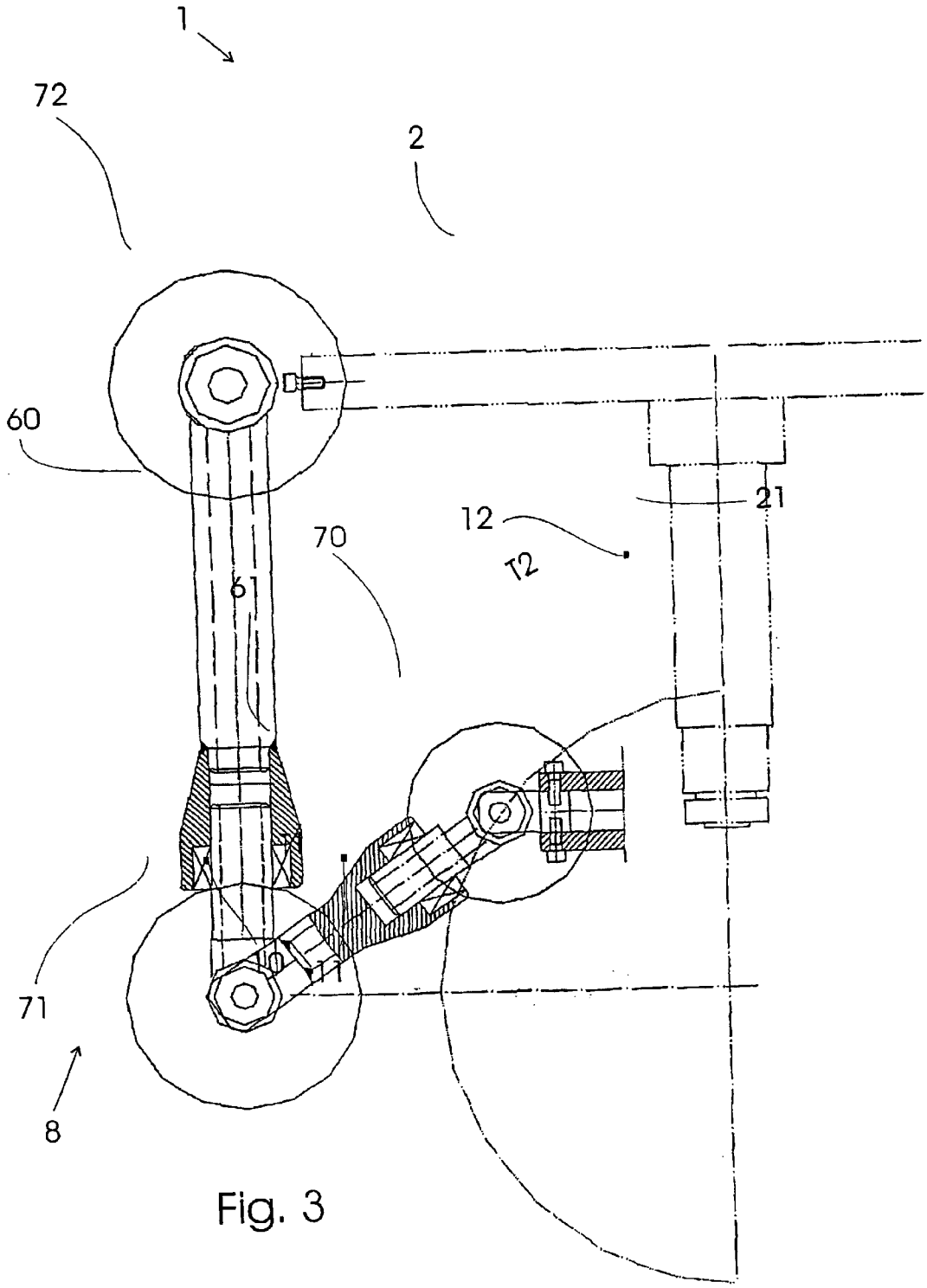
FIG. 3: a top view of the device illustrated in FIGS. 1 and 2.

As can be seen in FIGS. 1, 2, and 3, a first configurative variation of the present invention comprises a reinforcement device 1 for use in a Grotnes-type lamination machine, which have first and second horizontal laminating axles 21, 22 that are moveable and substantially parallel to each other, both axles 21, 22 having a roller 90 at their respective end regions.

The device 1 is constituted by a C-shaped body 4, the longitudinal axis of which is substantially parallel to the axles 21, 22, and is fixed to the housing 2 of the lamination machine by means of an articulated assembly 8 formed by a first articulation 72 associated to the housing 2 and to a first end of the first supporting arm 60, the first supporting arm 60 being substantially horizontal and parallel to the axles 21, 22 and having its second end associated to a second articulation 71. The second articulation 71 is also associated to a first end of a second supporting arm 6' that is substantially horizontal and substantially perpendicular to the axles 21, 22, the second end of which is associated to a third articulation 70, the third articulation 70 being also associated to the C-shaped body 4.

The C-shaped body 4 comprises two substantially U-shaped bearings 41, 42 the bearings 41, 42 being positioned in such a way, that their open portions face the respective end regions of the axles 21, 22, being further axially aligned and being moveable in a synchronized way in the longitudinal direction of the length of the body 4 and in opposite directions by means of respective first and second hydraulic-motion means 51, 52.

When the lamination machine is off or when no rim is being laminated, the body 4 is retracted in a rest position 10. In order to carry out the lamination of a rim (not shown), the latter should be place on the lamination machine between the first horizontal laminating axle 21, which has a first laminating roller 31, and the second horizontal laminating axle 22, which has second laminating roller 32. Next, the C-shaped body 4 is moved by a hydraulic moving device (not shown) located on the supporting arms 60, 61 through paths T1 and T2 (located on a substantially horizontal plane and comprising the supporting arms 60, 61), in this order, passing by an intermediate position 11 and assuming it work position 12. Then, the lamination machine moves the laminating axles 21, 22 vertically in opposite directions, approaching them to each other, while the first hydraulic moving means 51 and the second hydraulic moving means 52 move the bearings 41, 42 similarly to the movement of the axles, until the bearings 41, 42 rest on the respective rollers 90 and exert pressure on the respective axles 21, 22, thus generating a force component in a direction contrary to the component that causes flexion of the axles 21, 22, enabling them to work as parallel to each other as possible, thus bringing benefit to their durability and greater precision and uniformity to the wheel rims produced.

After the lamination of the rim is completed, the moving means 51, 52 move the bearings 41, 42 apart from each other. Then, the hydraulic device located on the supporting arms 60, 61 moves the C-shaped 4 through the horizontal paths T2 and T1, in this order, passing by the intermediate position 11, until it reaches the rest position 10, while the machine moves the axles 21, 21 vertically apart from each other and enables one to remove the mechanically conformed rim. Then, the lamination cycle of another rim begins.

Figure 4:
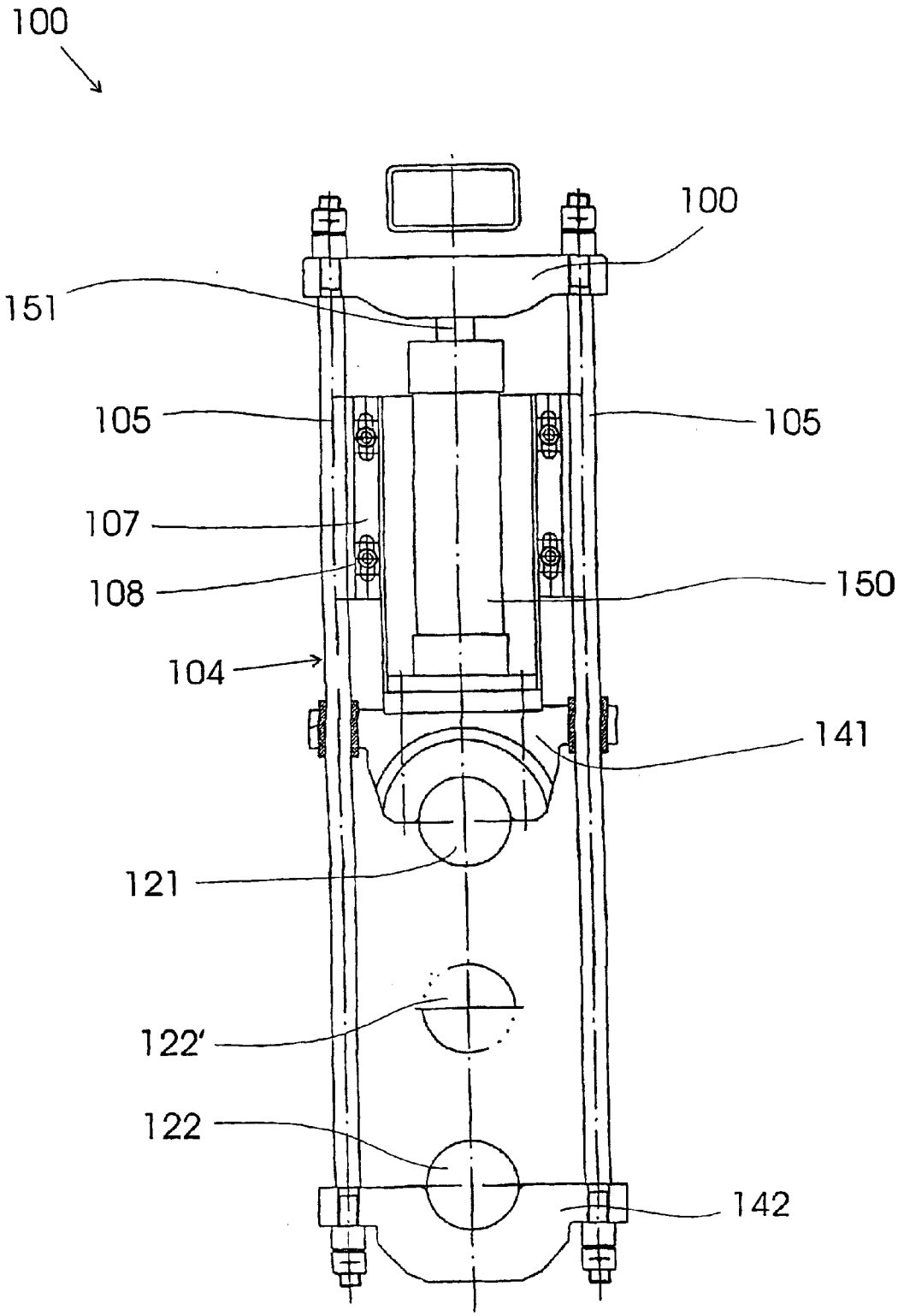
FIG. 4: a front view of a second configurative variation of the reinforcement device of the present invention.
Figure 5:
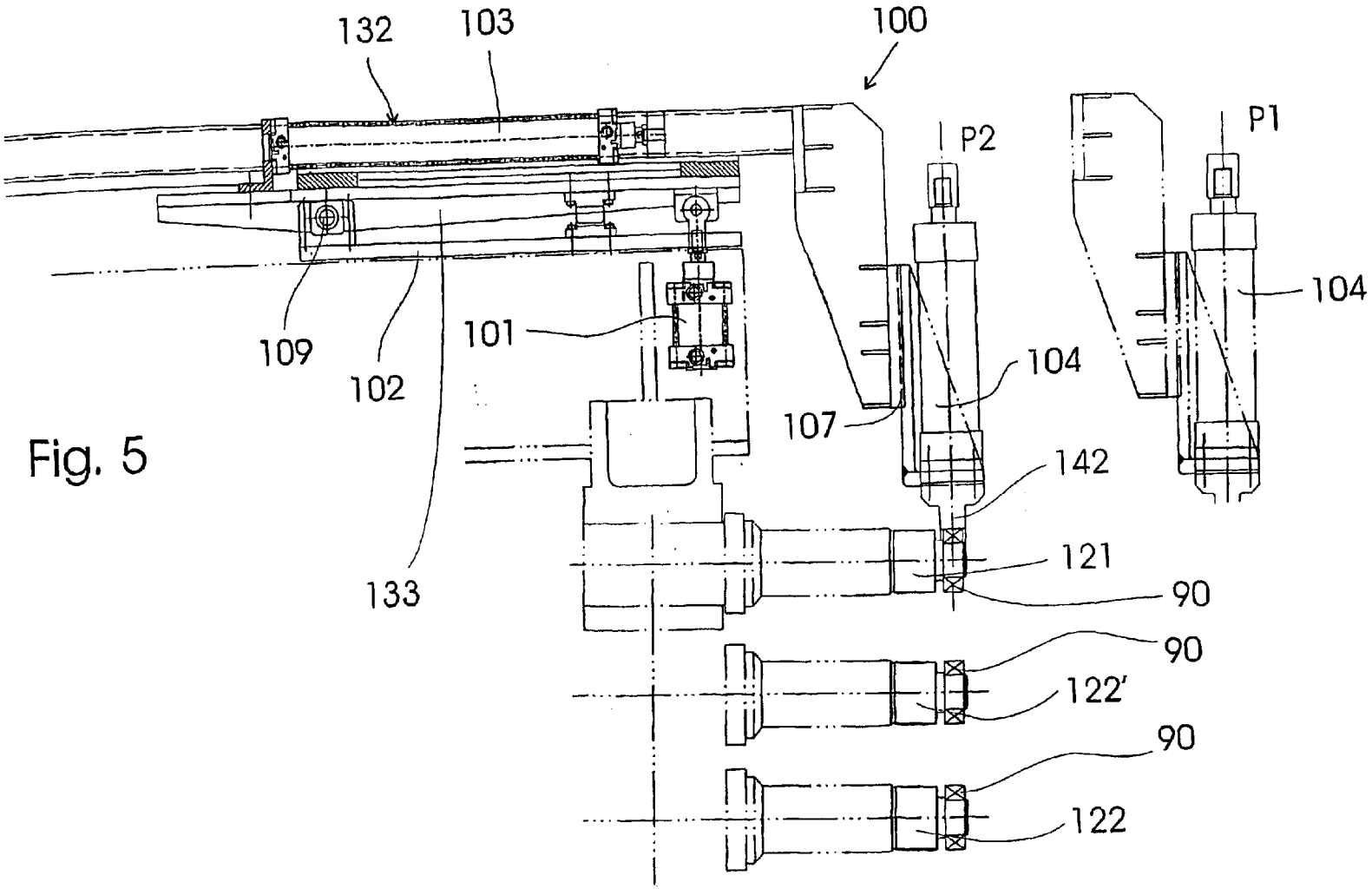
FIG. 5: a side view of the reinforcement device illustrated in FIG. 4; e
Figure 6:
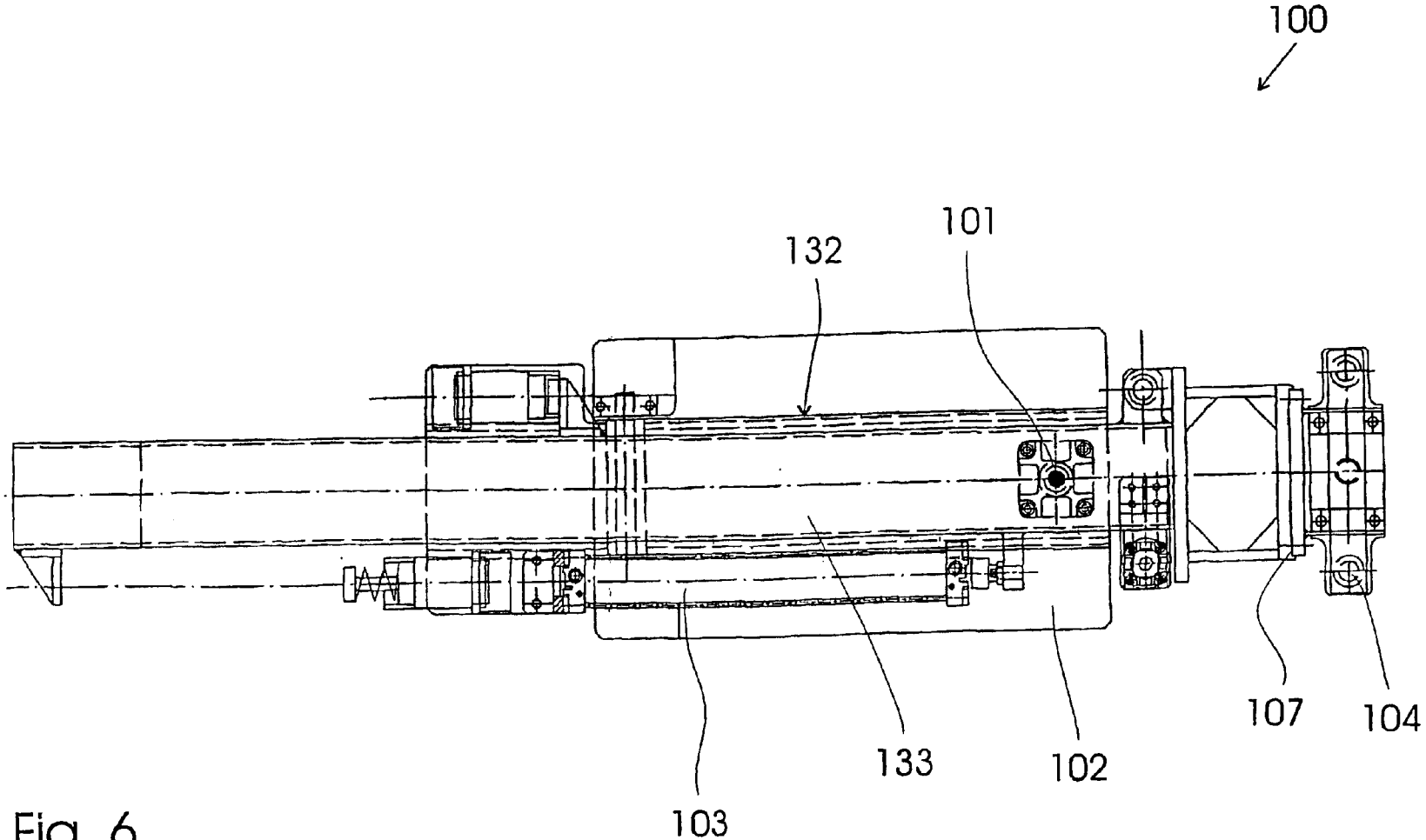
FIG. 6: a top view of the device illustrated in FIGS. 4 and 5.

A second embodiment of the present invention is illustrated in FIGS. 4–6 and comprises a reinforcement device 100 for use in Sudrad-type lamination machines, which comprise a first fixed horizontal laminating axle 121, and second horizontal laminating axle 122 that is vertically moveable, both axles 121, 122 having, at their respective end regions, a roller 90, the reinforcement device 100 being moveably associated with respect to the housing 102 of the machine.

The device 100 comprises a structure 132 that is substantially horizontal and parallel to the housing 102 of the lamination machine, a longeron 133 that is substantially horizontal and parallel to the housing 102, a third hydraulic moving means 103, composed by hydraulic cylinder substantially horizontal and parallel to the longitudinal axis of the structure 132, an articulation 109, and a fourth moving means 101, that is pneumatic and composed by a pneumatic cylinder substantially vertical and perpendicular to the longitudinal axis of the structure 132, the pneumatic moving means 101 and the articulation 109 being associated to the housing 102 of the machine and to the horizontal longeron 133, while the third hydraulic moving means 103 is associated to the longeron 133 and to the structure 132. Thus, the horizontal hydraulic cylinder of the third hydraulic moving means 103 permits horizontal movement of the structure 132 with respect to the longeron 103 in the direction of its longitudinal length, while the articulation 109 and the pneumatic moving means 101, which makes vertical movement, enable angular movement of the assembly comprising the longeron 133 and the structure 132, having the articulation 109 as a center. At a first end of the structure 132 a body 104 is fixed, which is substantially perpendicular to direction of the longitudinal length of the structure 132 and to the axles 121, 122.

The body 104 comprises two substantially parallel bars 105, a reinforcement element 106 associated to a fifth hydraulic moving means 150, the element 106 being substantially perpendicular to the bars 105, joining them to each other at their respective first ends, the body 104 further comprising a first bearing 142 associated to both bars 105 and substantially perpendicular to them, the bearing 142 further joining the two bars 105 by their respective second ends and functioning as a reinforcement element of the body 104. A second bearing 141 and the fifth hydraulic moving means 150 are fixed to the structure 132 of the device 100 on a joining surface 107, by means of four screws 108. Due to the conception of the bores of this surface 107, which permit fixation of the screws 108 in different vertical positions, it is possible to achieve a precise regulation of the positioning of the fifth hydraulic moving means 150 and of the second bearing 141 on the structure 132, thus contributing to increase the range of utilization of the lamination machine when it is coupled to the device 100. The bearings 141, 142 are substantially U-shaped and are positioned in such a way, that their open portions face the respective end regions of the axles 121, 122, the bearings 141, 142 being further aligned axially.

The body 104 is moveable in the direction of its longitudinal length by the fifth hydraulic moving means 150, by means of the rod 151. Therefore, the reinforcement element 106, the two bars 105 and the second bearing 142 move with respect to the fifth hydraulic moving means 150 and the first bearing 141.

When the machine is off or when no rim is being laminated, the body 104 is retracted in a rest position P1.

In order to carry out the lamination of a rim (not shown), the latter should be placed on the lamination machine between the fixed horizontal laminating axle 121, which has a first laminating roller (not shown), and the moveable horizontal laminating axle 122, which has a second lamination roller (not shown). Then, the lamination machine moves the moveable laminating axle 122 vertically as far as the position 122', approaching it to the fixed laminating axle 121, while the device 100 is horizontally moved by the third hydraulic moving means 103 in the direction of the longitudinal length of the structure 132, until it reaches the position P2. In this position P2, angular movement of the device 100 occurs, caused by the descending vertical movement of the pneumatic moving means 101, combined with the actuation of the articulation 109, thus causing the second bearing 141 to touch the roller 90 located at the outer portion of the axle 121 of the machine.

Simultaneously, the fifth hydraulic moving means 150 moves the body 104 in the rising vertical direction, causing the first bearing 142 to touch the roller 90 located at the outer portion of the axle 122, when the latter if located in the position 122'. Therefore, each of the bearings 141, 142 exerts pressure on the respective axle, generating a force component in a direction contrary to the component resulting from the force necessary to the mechanical conforming of the rim and that causes flexion of the axles 121, 122, thus enabling them to work as parallel to each other as possible, which brings benefits to their durability and greater precision and uniformity to the wheel rims produced.

After completing the lamination of the rim, the body 104 is moved in the vertical and descending direction by the fifth hydraulic moving means 150 apart from the bearing 142 of the axle 122, while the pneumatic moving element 101 makes rising vertical movement, thus moving the device 100 in an angular manner, having with the articulation 109 as a center, so that the second bearing 141 no longer touches the axle 121. Then, the third hydraulic moving means 103 moves the device 100 horizontally as far as the rest position P1, while the machine moves the axle 122 vertically apart from the axle 121 and enables one to remove the mechanically conformed rim. Then the cycle of lamination of another rim begins.

Evidently, a person skilled in the art understands that hydraulic, pneumatic or electric moving means may be indistinctly used, according to the needs or limitation of the project, without the invention undergoing any substantial alterations that differentiate it from the preferred embodiments cited above.

A preferred embodiment having been described, it should be understood that the scope of the present invention includes other possible variations, being limited only by the contents of the accompanying claims, included here as possible equivalents.

What is claimed is:

1. A reinforcement device adapted to reinforce a laminating machine used in a laminating process for laminating a rim of a wheel of an automotive vehicle, the laminating machine comprising two substantially parallel cantilevered rim-laminating axles each having an unsupported end, each unsupported end having a roller engaged therewith, said reinforcement device comprising:

a body adapted to be movably coupled to the laminating machine;

a pair of bearings mounted to the body, at least one of the bearings being operably engaged with the body so as to be movable with respect thereto, the bearings being capable of being positioned by movement of the body such that the unsupported ends of the axles are disposed between the bearings, the at least one movable bearing thereafter being capable of being moved with respect to the body such that the bearings engage and support the respective unsupported ends of the axles such that the axles remain in a substantially parallel manner during the lamination process.

2. A device according to claim 1 further comprising a moving means operably engaged between the body and each of the at least one movable bearing, the moving means being capable of moving the respective at least one movable bearing with respect to the body.

3. A device according to claim 1 wherein the body is substantially "C" shaped so as to have an elongate major portion having opposed ends and a minor portion extending from each end thereof, each minor portion having one of the bearings mounted thereto.

4. A device according to claim 1 further comprising a pair of moving means, each moving means being operably engaged between the body and one of the bearings such that both bearings are movable, each moving means being capable of moving the respective bearing with respect to the body.

5. A device according to claim 1 wherein the bearings are substantially "U" shaped so as to each define an open portion, and wherein bearings are mounted to the body such that the open portions of the bearings are directed toward each other when the bearings are moved to engage and support the unsupported ends of the axles.

6. A device according to claim 1 further comprising an articulating assembly operably engaged between the body and the laminating machine for moving the body with respect to the laminating machine.

7. A device according to claim 1 wherein the body further comprises two substantially parallel bars having corresponding first and second ends, the bars being coupled at the first ends thereof by a reinforcement element and at the second ends thereof by a first one of the bearings.

8. A device according to claim 7 further comprising a fifth moving means operably engaged between the reinforcement element and a second one of the bearings, the fifth moving means being configured to be capable of moving the reinforcement element so as to move the body and thereby move the first one of the bearings with respect to the second one of the bearings.

9. A device according to claim 8 wherein the second one of the bearings is fixedly engaged with the fifth moving means.

10. A device according to claim 9 wherein the bearings are substantially "U" shaped so as to each define an open portion, and wherein bearings are configured such that the open portions of the bearings are directed toward each other when the bearings are moved to engage and support the unsupported ends of the axles.

11. A device according to claim 7 further comprising an assembly including a longeron operably engaged with a supporting structure, the assembly being operably engaged between the body and the laminating machine for moving the body with respect to the laminating machine.

12. A device according to claim 11 wherein the body is operably engaged with the support structure such that the body is capable of being positionally adjusted with respect thereto.

13. A device according to claim 11 further comprising a third moving means, a fourth moving means, and an articulation, the fourth moving means and the articulation being operably engaged between the longeron and the laminating machine for moving the longeron with respect thereto and the third moving means being operably engaged between the support structure and the longeron for moving the support structure with respect thereto.

14. A device according to claim 13 wherein the laminating machine defines a longitudinal direction along the axles and the fourth moving means is configured to move the longeron perpendicularly to the longitudinal direction.

15. A device according to claim 14 wherein the articulation is operably engaged between the longeron and the laminating machine such that movement of the longeron by the fourth moving means pivots the longeron about the articulation and moves the support structure with respect to the axles.

16. A device according to claim 13 wherein the third moving means is configured to move the support structure along the longeron in parallel relation thereto.

17. A device according to claim 1 wherein the body and the bearings are configured to cooperate such that the bearings engage the rollers during the lamination process.

* * * * *